United States Patent [19]

Nakazeki et al.

[11] 4,333,435

[45] Jun. 8, 1982

[54] FUEL INJECTION DEVICE

[75] Inventors: Tsugito Nakazeki, Iwata; Haruhisa Harada, Kakegawa, both of Japan

[73] Assignee: NTN Toyo Bearing Company, Limited, Osaka, Japan

[21] Appl. No.: 23,281

[22] Filed: Mar. 23, 1979

[30] Foreign Application Priority Data

Apr. 24, 1978 [JP] Japan ..... 53/48868

[51] Int. Cl.[3] ..... F02D 3/00; F02D 5/02

[52] U.S. Cl. ..... 123/489; 123/478; 123/485

[58] Field of Search ..... 123/32 EE, 32 EA, 139 AW, 123/139 BG, 119 EC; 60/285, 276

[56] References Cited

U.S. PATENT DOCUMENTS 3,855,974 12/1974 Mayer ..... 60/285
3,949,714 4/1976 Mitchell ..... 123/32 EE
4,085,716 4/1978 Minami ..... 123/119 EC
4,089,311 5/1978 Brettschneider et al. ... 123/119 EC
4,138,979 2/1979 Taplin ..... 123/32 EE

FOREIGN PATENT DOCUMENTS 2001129 1/1979 United Kingdom ..... 123/119 EC

*Primary Examiner*—P. S. Lall
*Attorney, Agent, or Firm*—Armstrong, Nikaido, Marmelstein & Kubovcik

[57] ABSTRACT

A fuel injection apparatus of the type which uses a servomechanism utilizing a fluid to control the fluid-communication ratio of a fuel measuring gate disposed in a fuel supply passage. The device is so designed that signals which detect the operating condition of the engine control the amount of fuel to correct the air-fuel ratio so as to provide an ideal air-fuel ratio and that the set value for the servomechanism is controlled so that the output time ratio of fuel lean and rich signals included in the above-mentioned signals may be maintained at a predetermined value, thereby shortening the time required for correcting the air-fuel ratio.

2 Claims, 14 Drawing Figures

FUEL INJECTION DEVICE

BACKGROUND OF THE INVENTION (a) Field of the Invention

The present invention relates to an air-fuel ratio control mechanism for a fuel injection apparatus of the type which uses a servomechanism utilizing a fluid to control the fluid-communication ratio of a fuel measuring gate disposed in a fuel supply passage, wherein a sensor signal which detects the operating condition of the engine or a simulation signal which senses the operating condition of the engine is used to provide an air-fuel ratio optimum for the operating condition of the engine, namely, an ideal air-fuel ratio.

(b) Description of the Prior Art

As for techniques prior to the present invention, there are those which the present applicant applied for patent in Japan, and which are illustrated in FIGS. 1 and 2, respectively.

A fuel injection apparatus A shown in FIG. 1 comprises a servomechanism B using a fluid for maintaining at a predetermined value a pressure difference $P_1-P_2$ across a throttle valve 2 disposed in a suction pipe 1, and a fuel measuring and distributing mechanism C for measuring the amount of air being sucked into the internal combustion engine on the basis of the degree of opening of said throttle valve 2 and establishing unique correspondence between the degree of opening of the throttle valve 2 and the fluid-communication ratio, namely the opening time and/or area of opening, of a fuel measuring gate 3, 4 disposed in a fuel supply passage to maintain at a predetermined value a pressure difference $PF-P_i$ at the measuring gate 3, 4 for measuring the amount of fuel relative to the amount of suction air, said fuel injection apparatus A being designed so that the set value for said pressure difference $P_1-P_2$ across the throttle valve 2 (hereinafter referred to as the basic set value for the servomechanism is compensated by the output from a sensor 5 which detects the residual oxygen concentration in the exhaust gas. In this case, as an interface for control, use is made of a heater 8 enclosed in a bellows 7 interlocked to the pressure difference setting diaphragm 6 of the servomechanism B or use is made of a heater (not shown) associated with a bimetal disposed adjacent the pressure difference setting diaphragm 6.

An apparatus shown in FIG. 2 is designed so that the degree of opening of the valve 10 of a pressure regulator 9 which maintains at a predetermined value the difference between the supply pressure of fuel being supplied to a fuel measuring and distributing mechanism C and pressure in a suction pipe is controlled by a solenoid value 11 adapted to be actuated by the output from an exhaust gas sensor ($O_2$ sensor) 5, whereby the fuel supply pressure PF is varied to control the air-fuel ratio.

However, in the former apparatus, it takes much time for the heater 8 to be heated to vary the pressure in the bellows 7 or deform the bimetal, so that the speed of response to a variation in the conditions is low and particularly the ability to follow up transient conditions is poor, while in the latter apparatus, although the speed of response is high, the engine torque is liable to vary if the regulatable range is widened, so that there is a danger of the car driver to lose his sense of driving.

SUMMARY OF THE INVENTION (a) Objects of the Invention

An object of the present invention is to compensate the air-fuel ratio in accordance with the operating condition of an engine so as to maintain it at the theoretical air-fuel ratio.

The invention is intended to shorten the time required for compensating the air-fuel ratio so as to provide superior engine response.

Further, another object of the invention is to provide a control circuit for compensating the air-fuel ratio so as to introduce many control factors for detecting the operating condition of an engine, thus improving control accuracy and reliability.

(b) Features of the Invention

According to the present invention, a fuel injection apparatus of the type having a servomechanism using a fluid to maintain at a predetermined value the pressure difference across a throttle valve disposed in a suction pipe and adapted to measure the flow rate of air being sucked into an internal combustion engine on the basis of the degree of opening of the throttle valve and establish unique correspondence between the degree of opening of the throttle valve and the fluid-communication ratio of a fuel measuring gate disposed in a fuel supply passage is characterized in that the set value for a pressure regulator pr pressure difference regulator which maintains the pressure difference across the fuel measuring gate at a predetermined value is controlled by a signal from a sensor or simulator which detects the operating condition of the engine, so as to compensate the air-fuel ratio to make the latter equal to the theoretical air-fuel ratio. Further, according to the invention, the basic set value for said servomechanism and hence the basic fuel-air ratio determined in connection therewith are compensated so that the output time ratio of fuel lean and rich signals from said servomechanism may have a predetermined value, thereby shortening the time required for said compensation of air-fuel ratio to improve the ability to respond to the operating condition of the engine.

DESCRIPTION OF THE PREFERRED EMBODIMENTS

Figure 1:
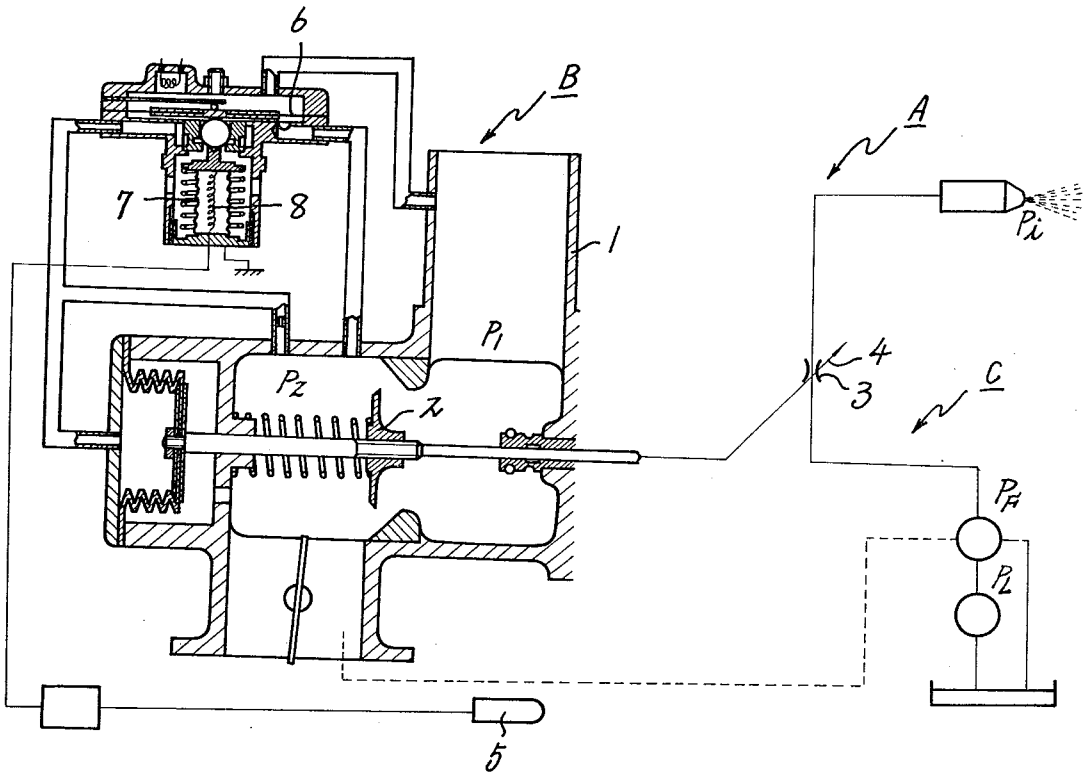
Fig 1 PRIOR ART
FIGS. 1 and 2 each illustrate a control mechanism for a fuel injection apparatus previously proposed by the present applicant.
Figure 2:
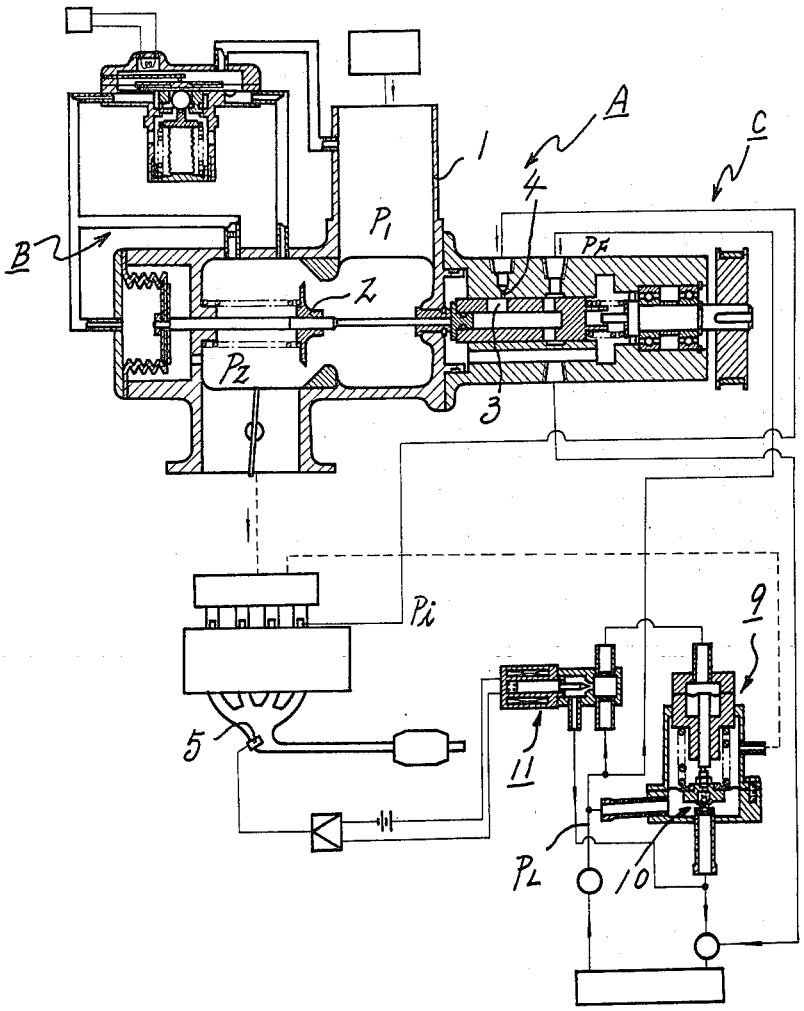
Fig 2 PRIOR ART
Figure 3:
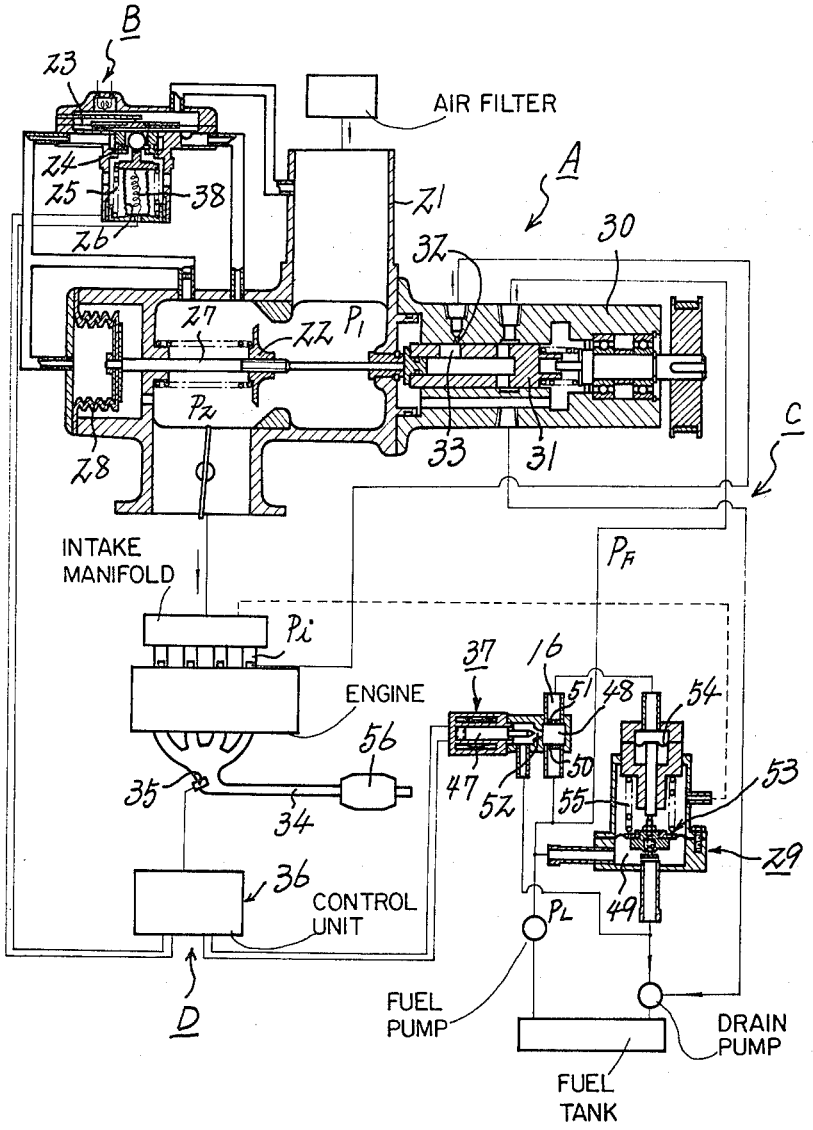
FIG. 3 illustrates a fuel injection apparatus according to a first embodiment of the invention.
Figures 4, 5, 6:
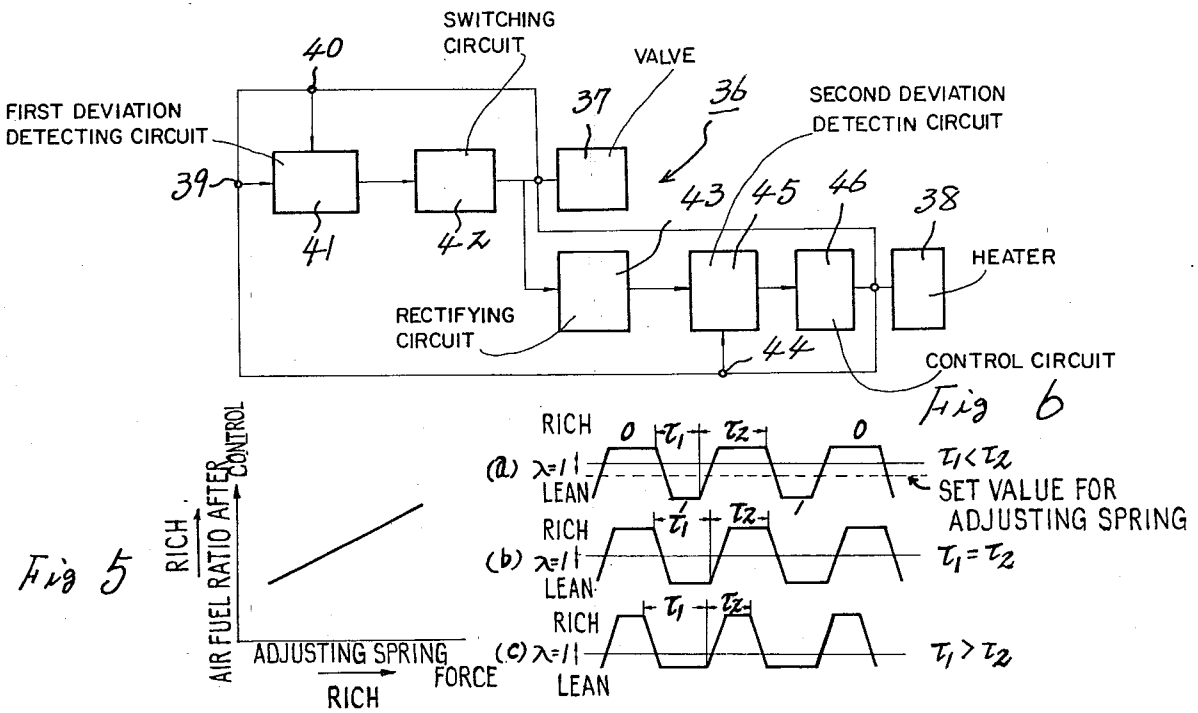
FIG. 4 is an illustrative view of a control unit.
FIG. 5 is a graph showing the relation between A/F and adjusting spring pressure after control operation.
FIG. 6 is a graph showing the relation between fuel pressure $P_f$, exceed air factor $\lambda$, and set spring pressure for an adjusting spring.

Referring to FIG. 3, a fuel injection apparatus A comprises a servomechanism B utilizing a fluid, a fuel measuring and distributing mechanism C and a control mechanism D. The servomechanism B comprises a pressure difference setting diaphragm 23 for detecting variations in the pressure difference $P_1-P_2$ across a throttle valve 22 disposed in a suction pipe 21, a variable orifice 24 interlocked to said pressure difference setting diaphragm 23, a spring 25 and bellows 26 for setting the servo basic set value, and an actuator 28 which transmits the output from the servo via a control bar 27. The fuel measuring and distributing mechanism C comprises a pressure regulator 29 for maintaining the difference $PF-P_i$ between suction pipe negative pressure and supply source pressure at a predetermined value, and a fuel measuring gate 32, 33 defined between a main body 30 and a rotor 31 adapted to be rotated within the main body 30 in synchronism with the rpm of an internal combustion engine and slidable in relation to the degree of opening of said throttle valve 22. The control mechanism D comprises an exhaust gas sensor 35 attached to an exhaust pipe 34, a control unit 36 adapted to produce a control signal depending upon data from said exhaust gas sensor 35, a valve 37 adapted to be turned on and off by the output from said control unit 36 so as to control the fuel supply pressure $P_f$, and a heater 38 the energizing voltage on which is controlled by said control unit 36 and which is enclosed in the bellows 26 of said servomechanism B. The control unit 36, as shown in FIG. 4, comprises a first deviation detecting circuit 41 for making a comparison between a signal from an input terminal 39 for receiving the output from the exhaust gas sensor 35 and a signal from an input terminal 40 for receiving a set value, a switching circuit 42 for receiving a comparison value from said first deviation detecting circuit 41 to on-off control said valve 37, a rectifying circuit 43 for receiving a signal from said switching circuit to rectify it, a second deviation detecting circuit 45 for making a comparison between a signal rectified in said rectifying circuit 43 and a set value from said input terminal 44, and a control circuit 46 for controlling the energizing voltage on said heater 38 by a comparison value from said second deviation detecting circuit 45.

The air fuel ratio control comprises a closed loop control system composed of the feed line of the fuel injection apparatus A, the exhaust gas sensor 35 and control unit 36, and a servo control system adapted to compensate the basic set value for the servo to control slight errors in said closed loop control system. The output from the exhaust gas sensor 35 attached to the exhaust pipe 34 is transferred to the first deviation detecting circuit 41 of the control unit 36 and is compared with the input or set comparison value. The deviation detecting circuit 41 is connected to the switching circuit 42 and performs an on-operation when the signal is greater than the set value and an off-operation when the signal is smaller than the set value, thereby operating the valve 37. That is, when the solenoid valve 47 of the valve 37 is in its closed state, the pressure in the chamber 48 is equal to the pressure PF in the chamber 49 of the pressure regulator 29, and when the solenoid valve 47 is energized into its open state, the pressure in the chamber 16 becomes a pressure $P_c$ determined by orifices 50, 51 and 52. This pressure $P_c$ acts on an upper chamber above a compensating diaphragm 54 interlocked to the setting diaphragm 53 of the pressure regulator 29 to reduce the set value for the setting diaphragm 53, eventually reducing the fuel supply pressure PF.

The set value for the pressure regulator 29 is given by an adjusting spring 55 which is so controlled that with the solenoid valve 47 closed, the air-fuel ratio in this apparatus is closer to the fuel rich side than the theoretical air-fuel ratio and that with the solenoid valve 47 opened, it is closer to the fuel lean side than the theoretical air-fuel ratio. When the output from the exhaust gas sensor 35 is greater than the set value, the solenoid valve 47 is opened, so that the supply pressure PF determined by the pressure regulator 29 is reduced to shift the air-fuel ratio to the fuel lean side. This shift of the air-fuel ratio causes the output from the exhaust gas sensor 35 to be lower than the set value, so that the solenoid valve 47 is closed to shift the air-fuel ratio to the fuel rich side. With such operations repeated, the exhaust gas from the internal combustion engine is made average such that in the vicinity of the entrance to a three-way catalyst 56 disposed in the exhaust pipe 34, the exhaust gas substantially corresponds to the theoretical air-fuel ratio and is cleaned by the catalyst 56.

In this connection, even if the setting of the adjusting spring 55 is in the control range, there is a possibility that the mixed gas will deviate either to the fuel rich side or to the fuel lean side depending upon the operating condition of the engine. It has been ascertained that, as shown in FIG. 5, if the force of the adjusting spring 55 is set to the fuel rich side, the after-control air-fuel ratio also deviates to the fuel rich side. It is the control system of the servo that compensates for such deviation.

FIG. 6 is a graph showing the relation between the fuel pressure $P_f$, the excess air factor λ and the set spring pressure of the adjusting spring 55. In the graph, $\tau_1$ is the on-time of the solenoid valve and $\tau_2$ is the off-time thereof. In order to control the excess air factor λ so that $\lambda=1$, it has been found optimum to maintain the ratio between $\tau_1$ and $\tau_2$ constant over the entire operating range.

This control operation is performed in the following manner.

The output from the exhaust gas sensor 35 is produced as an on/off signal in the switching circuit, as described above. This on/off signal is transferred to the rectifying circuit 43 in such a manner that it is 1 when the switching circuit 42 is on and it is 0 when the switching circuit is off. In the rectifying circuit, it is rectified and transferred to the second deviation detecting circuit 45. For example, in the case of FIG. 6 (*a*), $\tau_1<\tau_2$, so that the output from the rectifying circuit 48 is not more than 0.5. At the same time, a set value such that $\tau_1=\tau_2$, namely a set value of 0.5 is fed in from the terminal 44, and a signal is continuously produced until the comparison value between the two is zero. The voltage on the heater 38 is controlled in the reducing direction by the control circuit 46 so as to lower the temperature in the bellows to control the air-fuel ratio to the fuel rich side. In the reversed case shown in FIG. 6 (*c*), the output from the rectifying circuit is also between 0.5 and 1 and the air-fuel ratio is controlled to be shifted to the fuel lean side until $\tau_1=\tau_2$.

Figure 7:
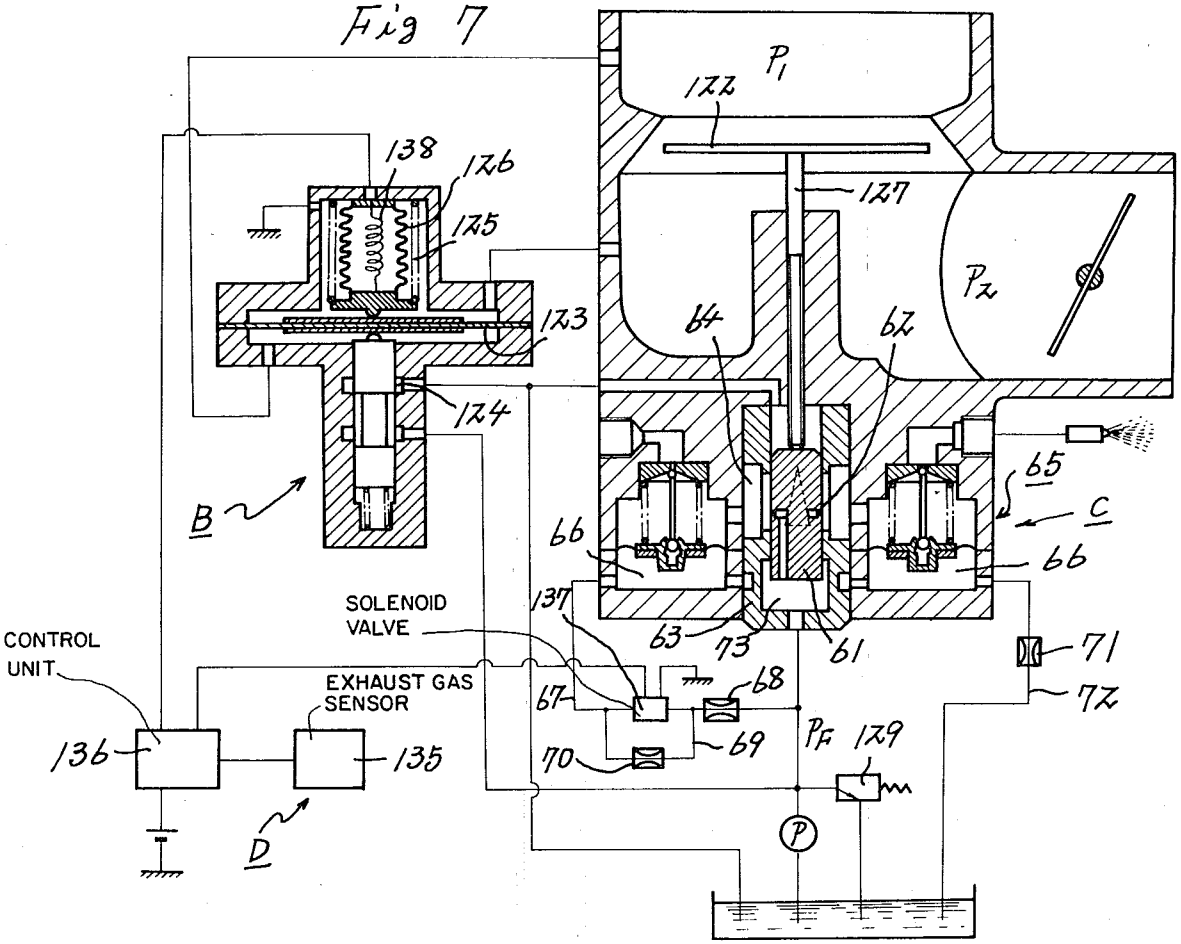
FIG. 7 is an illustrative view of a second embodiment of the invention.

FIG. 7 shows a second embodiment of the present invention, wherein the same parts as in the first embodiment are indicated by the corresponding 3-figure numbers. A fuel measuring and distributing mechanism C is designed to continuously measure fuel in connection with the amount of air being sucked. More particularly, an annular slit 62 formed in a spool 61 cooperates with a substantially triangular window 64 formed in a sleeve 63 to define a fuel measuring gate. Designated at 65 is a pressure difference control unit for maintaining at a predetermined value the pressure drop at the fuel measuring gate 62, 64. A servomechanism B utilizes the fuel pressure as a control pressure and the output therefrom acts on the upper surface of the spool 61. A pipe 67 connecting the high pressure chamber 66 of the pressure difference control unit 65 to the fuel source pressure is provided with a solenoid valve 137 and a choke 68 while a pipe 69 for bypassing the solenoid valve is provided with a choke 70. In addition, the numeral 71 designates a choke disposed in a return pipe 72.

The output from the exhaust gas sensor 135 actuates the control unit 136 to on/off control the solenoid valve 137, and by controlling the pressure difference between the high pressure chamber 66 and a lower chamber 73 below the spool 61, the flow rate of fuel flowing through the fuel measuring gate 62, 64 is controlled. The heater 138 is controlled so that $\tau_1=\tau_2$, as in the case of the first embodiment.

In the first and second embodiments, however, since the exhaust gas sensor for detecting the operating condition of the engine comprises an exhaust gas sensor 5 alone, this is insufficient for detecting the entire operating condition at the start, during acceleration and at full throttle. Moreover, the control unit 36 is not designed to utilize triangular waves having a fixed frequency and amplitude and since it takes some time for the exhaust gas sensor 5 to assume the normal operating condition after the engine is started, accurate air-fuel ratio control is impossible during this period.

In order to solve this problem, the applicant provides the following embodiments of the invention.

Figure 8:
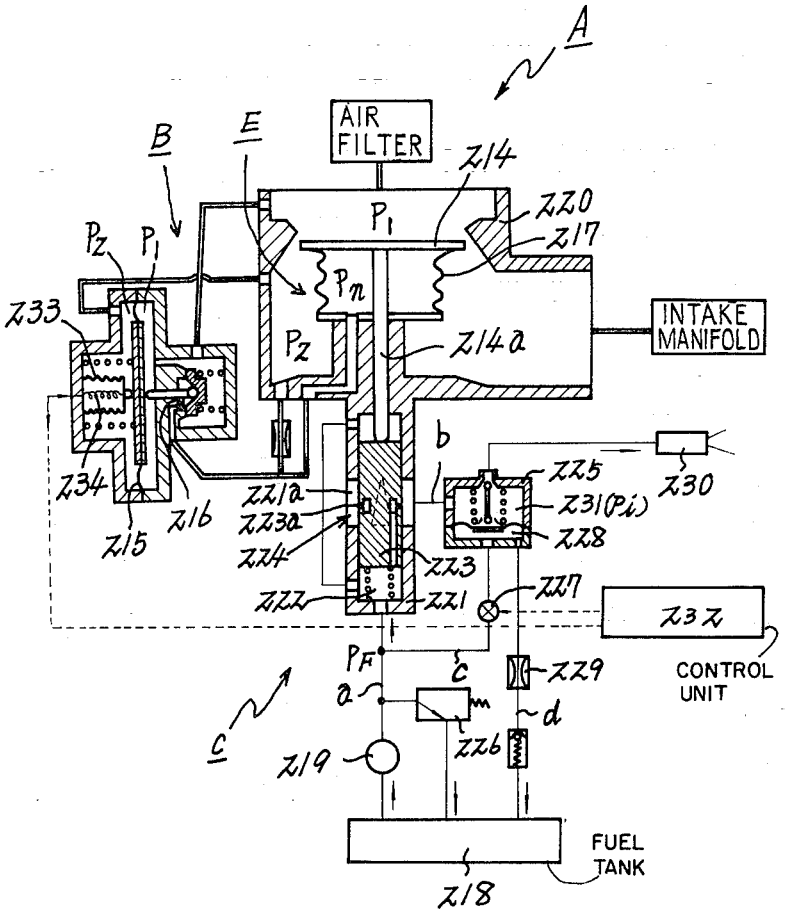
FIG. 8 is a complete layout of an apparatus according to a third embodiment of the invention.

FIG. 8 is an entire layout of a fuel injection apparatus A according to a third embodiment of the invention. A servomechanism B includes a diaphragm 215 for sensing the pressure difference $P_1-P_2$ across a flow rate detecting valve (throttle valve) 214. When the pressure difference $P_1-P_2$ deviates from the basic set value, the area of opening of a variable orifice 216 is varied and the drive pressure $P_n$ for a valve opening mechanism E which varies between $P_1$ and $P_2$ in proportion to said area of opening is caused to vary depending upon said deviation and such pressure is transferred to an actuator 217 to correct the degree of opening of the flow rate detecting valve 214 in a direction which causes the pressure difference $P_1-P_2$ to assume a fixed value, so that the area of opening of the detecting valve 214 is proportional to the amount of air passing therethrough and hence it becomes possible to measure the flow rate of air on the basis of the area of opening of the air flow rate detecting valve 214. Thus, this arrangement constitutes a so-called area type air flow rate measuring mechanism.

The variation of the area of opening of the air flow rate detecting valve 214 is proportional to the axial displacement of the rod 214*a*. By interlocking the fuel measuring and distributing mechanism C to said rod 214*a*, the flow rate of air is kept proportional to the flow rate of fuel measured by said mechanism C, whereby a fixed air-fuel ratio is obtained. In this connection, the pressure difference across the air flow rate detecting valve 214 is determined by the basic set value for the servomechanism B which controls it, whereby the area of opening of the flow rate detecting valve 214 and the axial displacement of the rod 214*a* are determined. Therefore, said air-fuel ratio can be determined by the basic set value for the servomechanism B. The air-fuel ratio thus determined is referred to as the basic air-fuel ratio. The fuel measuring and distributing mechanism C includes a pump 219 which supplies the fuel in a tank 218 to a lower chamber 222 in a main body 221 integral with a suction pipe 220. The fuel is passed through a variable orifice (measuring gate) 224 defined by a slit 223*a* in a spool 223 axially slidable in the main body and by the triangular window 221*a* of the main body 221. Since the spool 223 follows up the rod 214*a*, the area of opening of said measuring gate 224 is proportional to the area of opening of the flow rate detecting valve 214, and by maintaining the fuel pressure difference across the measuring gate at a constant value by the pressure regulator 225, the flow rate of fuel proportional to the flow rate of air is measured. The numeral 226 designates a relief valve for maintaining at a constant value the fuel pressure PF in a fuel line a acting on the lower chamber 222; 227 designates a solenoid valve disposed in a fuel line c communicating with the lower chamber 228 of the pressure regulator 225 branching off from the fuel line a; 229 designates an orifice disposed in a fuel line d connecting the lower chamber 228 to the tank 218; 230 designates an injector communicating with the measuring gate 224 through the upper chamber 231 of the pressure regulator 225 and through the line b; and 232 designates a control unit for controlling the on-off time ratio of said solenoid valve 227 and the on-off operation of a heater 234 installed in the bellows 233 of the servomechanism B in accordance with signals from sensors to be later described for detecting the operating condition of the engine.

The present invention is characterized by the arrangement of the control unit 232 to be later described. The on-off time ratio of the solenoid valve 227 cooperates with the orifice 229 in the fuel line d to vary the pressure in the lower chamber 228 of the pressure regulator 225. Since the pressure regulator 225 acts to maintain the pressure difference between the lower and upper chambers 228 and 231 of the pressure regulator 225 at a constant value, the pressure $p_i$ in the upper chamber 231 also varies with the pressure in the lower chamber 228. However, since the supply pressure PF in the line a is maintained constant by the relief valve 226, the pressure difference $PF-P_i$ across the measuring gate 224 varies and the flow rate of fuel passing through the measuring gate 224 and measured thereby is compensated with respect to the flow rate of air, thus making it possible to vary the air-fuel ratio in connection with the operating condition of the engine.

On the other hand, the bellows 233 of the servomechanism B has a gas enclosed therein at standard atmospheric pressure and temperature (e.g., 1 atm., 20° C.) and compensates the flow rate of air for variations in the atmospheric pressure and temperature, thereby maintaining the air-fuel ratio at a constant value irrespective of such variations. However, on-off controlling the heater 234 in the bellows 233 results in varying the temperature and hence pressure of the gas in the bellows 233, thus compensating the basic set pressure difference $P_1-P_2$ acting on the diaphragm 215. In this case, since $P_1$ may be considered to be equal to the atmospheric pressure, if $P_2$ is increased, the pressure difference $P_1-P_2$ across the flow rate detecting valve 214 is decreased and the flow rate of air with respect to the predetermined area of opening of the flow rate detecting valve 214 is decreased, so that the air-fuel ratio is corrected to the fuel rich side. This correcting operation is performed by turning off the heater 234 to decrease the temperature in the bellows and the gas pressure, thereby lowering the pressure in the bellows 233.

The control operation of the control unit 232 on the solenoid valve 227 and heater 234 will now be described with reference to FIGS. 9 through 14.

Figure 9:
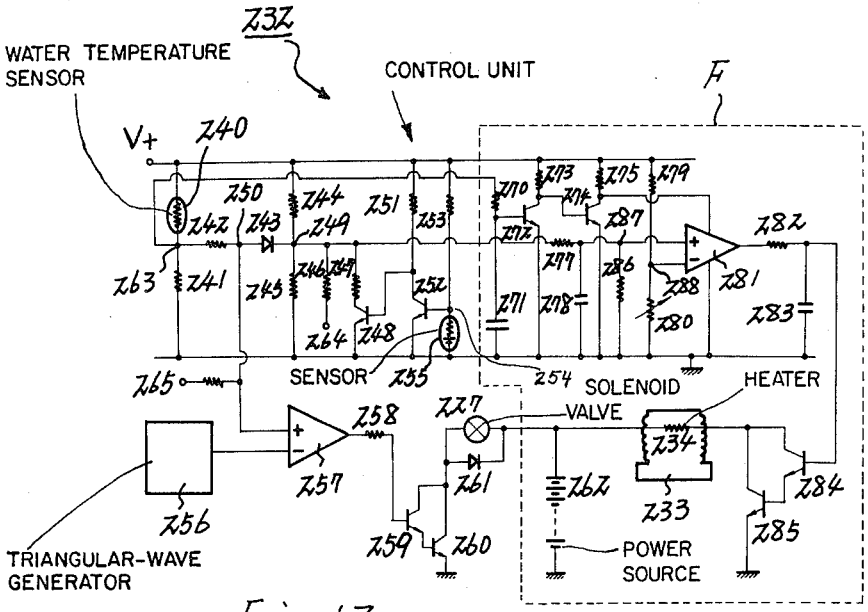
FIG. 9 is an electric circuit diagram for a control unit.

FIG. 9 is an electric circuit diagram for the control unit 232. The numeral 240 designates a water temperature sensor for detecting the engine cooling water temperature. The voltage at the point of connection 263 between the water temperature sensor 240 and a fixed resistor 241 varies with the temperature detected by the water temperature sensor 240. Thus, as the temperature increases, the resistance decreases and the voltage increases. The voltage at this point of connection 263 is applied to the non-reversed input side of a comparing unit 257 through a resistor 242, while the reversed input of the comparing unit 257 is connected to a triangular-wave generator 256. The output of the water temperature sensor 240 is connected through a diode 243 to a voltage divider comprising resistors 244, 245 and 247. Designated at 255 is an $O_2$ sensor disposed in the exhaust system for detecting the components of the exhaust gas to produce an electric signal. The $O_2$ sensor 255 is connected to a resistor 253 and the base of a transistor 252 whose collector is connected to a resistor 251 and the base of a transistor 248 whose collector is connected to a resistor 247. The output from the comparing unit 257 is transferred to the base of a transistor 259 through a resistor 258 to energize the solenoid valve 227 connected to the collector of said transistor 259. The numeral 261 designates a diode connected in parallel with said solenoid 227; 262 designates a power source; and 260 designates a transistor whose base is connected to the emitter of the transistor 259. By selecting the value of the resistor 242 which is greater than those of the resistors 244, 245, 246 and 247, the input voltage on the comparing unit 257 at the point of connection 250 has its maximum value determined by the voltage at the point of connection 249 constituting the voltage divider. In other words, when the voltage at the point of connection 263 is lower than that at the point of connection 249 (i.e., when the water temperature is low), the operation of the diode 243 causes the voltage at the point of connection 263 to be the input voltage on the comparing unit 257. In a reversed case, it is determined by the voltage at the point of connection 249. The voltage at the point of connection 249 is determined by either the conduction or nonconduction of the transistor 248, while the conduction and nonconduction of the transistor 248 are determined by the transistor 252.

If the temperature of the $O_2$ sensor 255 is low and the internal resistance is high or if a fuel rich signal is produced during high temperature, then the base voltage of the transistor 252 (the voltage at the point of connection 254) is high and the transistor 252 is rendered conductive, with the base current of the transistor 248 flowing from the collector to the emitter of the transistor 252, thereby cutting off the transistor 248. As a result, the voltage at the point of connection 249 is determined by the resistors 144 and 245 and becomes high. Further, when the $O_2$ sensor 255 is producing a fuel lean signal during high temperature, the base voltage of the transistor 252 is low, so that it is cut off. As a result, a base voltage is applied to the transistor 248 through the resistor 251, so that the transistor 248 is rendered conductive. Therefore, this time, the voltage at the point of connection 249 is determined by the resistors 244, 245 and 247 and becomes low.

Thus, the voltage at the point of connection 249 produces a pulse having an amplitude determined by the resistors 244, 245 and 247 in response to the temperature of the $O_2$ sensor 255 and $\lambda$ signal (fuel rich or lean signal).

Figure 10:
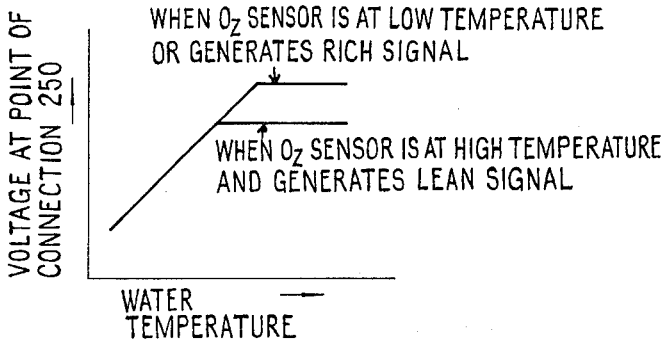
FIG. 10 is a graph showing control voltage on a comparing unit associated with solenoid valve.

If the value of the resistor 242 is sufficiently high as compared with those of the resistors 244, 245 and 247, the voltage appearing at the point of connection 250 is controlled by the water temperature sensor 240 and $O_2$ sensor 255, as shown in FIG. 10. The voltage at the point of connection 250 is applied to the non-reversed input side of the comparing unit 257 and compared with a triangular wave having a fixed amplitude and a fixed period sent from the triangular-wave generator 256 on the reversed input side. If the control voltage at the point of connection 250 is higher than the triangular wave voltage, the output from the comparing unit 257 is plus. As a result, the transistor 259 conducts and the current is amplified by the transistor 260, so that a current flows from a power source 262 through the solenoid valve 227 to energize the latter. On the other hand, if the control voltage at the point of connection 250 is lower than the triangular wave voltage, the output from the comparing unit 257 is minus and the transistors 259 and 260 are cut off, deenergizing the solenoid valve 227.

Figure 11:
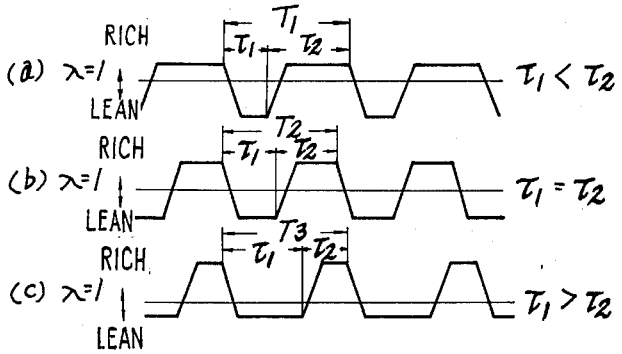
FIG. 11 is a graph showing the time signal $\lambda$ ratio of the $O_2$ sensor valve.

Therefore, the on-off time ratio of the solenoid valve 227 is proportional to the pulse at the point of connection 249 determined by the water temperature sensor 240 and $O_2$ sensor 255 detecting the operating condition of the engine, and air-fuel ratio can be made equal to the theoretical air-fuel ratio (excess air factor $\lambda=1$) suited to the operating condition of the engine in the manner described above. The time signal $\lambda$ ratio of the $O_2$ sensor 227 may then be divided into three classes a, b and c, as shown in FIG. 11, with $\tau_1$ indicating rich signal time and $\tau_1$ indicating signal time. As is clear from FIG. 11, 1 cycle $T_1$ for the class a where $\tau_1<\tau_2$ and 1 cycle $T_3$ for the class c where $\tau_1>\tau_2$ are each longer than 1 cycle $T_2$ for the class b where $\tau_1=\tau_2$. Thus, $T_1>T_2$ and $T_3>T_2$. Therefore, if $\lambda$ is to be controlled so that $\lambda=1$, the quickest control and hence improved response to the engine can be achieved where $\tau_1=\tau_2$, i.e., where the rich signal time and lean signal time of the $O_2$ sensor are set equal to each other. To this end, if the $\lambda$ deviates from the relation $\tau_1=\tau_2$ during the operation of the engine, it is necessary to correct such deviation.

Figure 12:
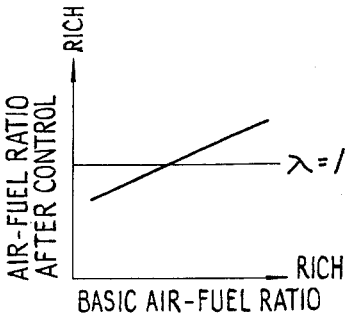
FIG. 12 is a graph showing basic air-fuel ratio-after-control air-fuel ratio characteristics.
Figure 13:
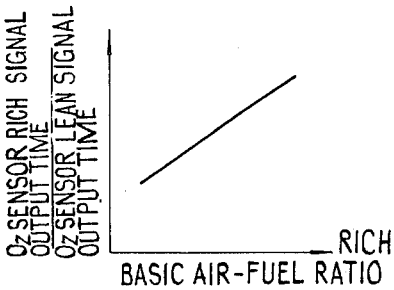
FIG. 13 is a graph showing basic air-fuel ratio-$O_2$ sensor λ signal characteristics.

In this connection, the air-fuel ratio which is controlled by the solenoid valve 227 so that $\lambda=1$, is determined by the basic air-fuel ratio of the servomechanism B, as shown in FIG. 12. This will become clear from the previous description of the servomechanism B shown in FIG. 8. The relation of the basic air-fuel ratio to the $O_2$ sensor signal (fuel lean signal output time/fuel lean signal output time) is such that, as shown in FIG. 13, as the basic air-fuel ratio approaches the fuel rich side, the fuel rich signal output time of the $O_2$ sensor becomes longer. This embodiment takes this relation into consideration, and if the relation $\tau_1=\tau_2$ of the solenoid valve 227 deviates, the heater 234 in the bellows 233 of the servomechanism B is controlled to vary the basic value $P_1-P_2$ for the diaphragm 215 to control the basic air-fuel ratio so that $\tau_1=\tau_2$.

This will now be described in more detail. A section F in FIG. 9 is a control mechanism for the heater 234. Thus, the voltage at the point of connection 249 which varies with the output from the $O_2$ sensor 255 is applied to the non-reversed input side of the comparing unit 281 via resistors 277, 286 and a capacitor 278, the reversed input side being connected to a voltage divider comprising a fixed resistor 279 and a variable resistor 280. The output from the water temperature sensor 240 is applied to the base of the transistor 272 and to a capacitor 271 via a resistor 270 . A resistor 273 on the collector of the transistor 272 is connected to the base of the transistor 274 and a resistor 275 on the collector of the transistor 274 is connected to the power circuit of the comparing unit 281. The output of the comparing unit 281 is connected to the base of a transistor 284 via an integrating circuit comprising a resistor 282 and capacitor 283. The base of a transistor 285 is connected for amplification to the emitter of the transistor 284. The collector of the transistor 285 has connected thereto the heater 234 in the bellows 233 of the servomechanism B. The other end of the heater 234 is connected to the plus side of the power source 252. On the other hand, the power circuit of the comparing unit 281 is connected to the collector of the transistor 274. Since its base is connected to the collector of the transistor 272, the power source for the comparing unit 281 will be cut off if the temperature is lower than the set temperature. This set temperature is determined by the size of the resistor 270.

If the engine is re-started with the water temperature sufficiently high, the $O_2$ sensor, whose heat capacity is small, will cool more quickly than the hot water, so that the internal resistance of the $O_2$ sensor 255 is high and since it is inactive, the power source for the comparing unit 281 is cut off for a fixed period of time after the re-start.

The voltage at the point of connection 249, as described above, is a rectangular wave having a fixed amplitude determined by the λ signal from the $O_2$ sensor 255. This voltage is rectified in a smoothing circuit comprising resistors 277, 286 and a capacitor 278 and the average voltage is applied to the non-reversed input side of the comparing unit 281, where it is compared with the set voltage between the resistors 279 and 280 of the voltage divider on the reversed input side. If the averaged voltage at the point of connection 287 is higher than the voltage at the point of connection 288, the comparing unit 281 will produce an output "1" and in a reversed case it will produce an output "0". If the time ratio where the voltage at the point of connection 249 is high and where it is low, is constant, that is, the ratio between the fuel rich signal output time $\tau_1$ and fuel lean signal output time $\tau_2$ of the $O_2$ sensor is constant, for example, if $\tau_1=\tau_2$, which is the class b in FIG. 11, then the "1" and "2" output time ratio of the comparing unit 281 is equal to 1, and the average value rectified by the resistor 282 and capacitor 283 is "0.5", which indicates the basic value. By amplifying this basic value by the transistors 284 and 285, the current flowing from the power source 262 through the heater 234 to the collector of transistor 285 and then to its emitter is set to the basic current for the heater 234.

If the time $\tau_1$ during which the fuel rich signal is produced by the $O_2$ sensor is long, that is, in the case of the class c in FIG. 11 where $\tau_1>\tau_2$, since the time during which the high voltage at the point of connection 249 is produced is long, the time during which "1" is produced by the comparing unit 281 is long. Thus, the average value rectified by the resistor 282 and capacitor 283 is within the range of "0.5-1" and is higher than "0.5" and this increment is rectified by the transistors 284 and 285 and by this amount the current flowing from the power source 262 to the heater 234 increases from the basic value. As a result, the gas temperature in the bellows becomes higher and the pressure therein increases, so that the basic set value $P_1-P_2$ acting on the diaphragm 215 increases. Accordingly, the pressure difference across the air flow rate detecting valve 214 increases, and the flow rate of air flowing at said compensated basic set pressure $P_1-P_2$ with respect to the fixed area of opening of the valve 214 increases, so that the basic air-fuel ratio is compensated toward the fuel lean side. In other words, it is compensated such that the ratio between the fuel rich signal output time $\tau_1$ and the fuel lean signal output time $\tau_2$ is equal to 1. In the case where the time $\tau_2$ during which the fuel lean signal is produced by the $O_2$ sensor 255 is long, the reverse to the above compensating operation is performed.

Figure 14:
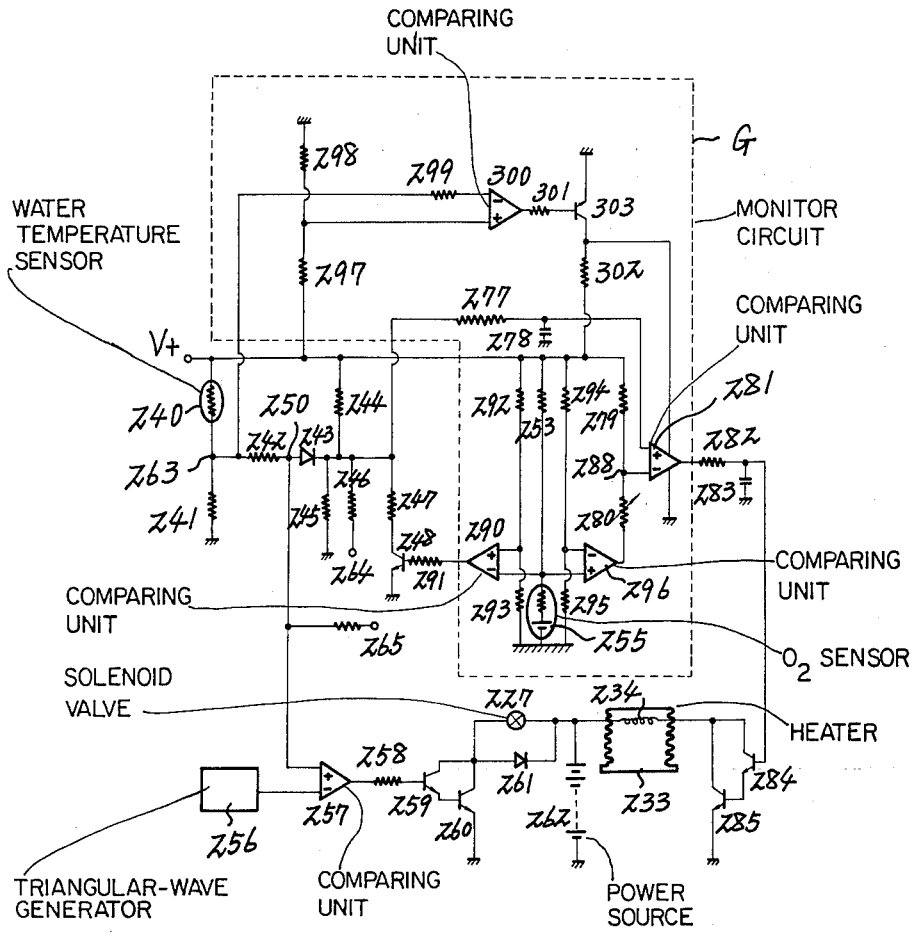
FIG. 14 is an electric circuit diagram for a control unit according to a fourth embodiment of the invention.

As a result of the control unit 232 operating in this way, the λ signal cycle of the $O_2$ sensor 255 for maintaining the theoretical air-fuel ratio is shortened, thus improving the engine response and control accuracy. FIG. 14 illustrates a fourth embodiment of the invention, wherein a monitor circuit G is provided so that when the $O_2$ sensor 255 has a high internal resistance (i.e., when the sensor is at a low temperature or is out of order), the heater 234 may not be energized. In operation, the output from the $O_2$ sensor 255 is compared in a comparing unit 290 to actuate a transistor 248. The maximum output from the $O_2$ sensor is compared with the set value in a comparing unit 296 and if it is greater (i.e., the internal resistance is high as when the $O_2$ sensor is at a low temperature or is out of order), the reversed input which is the set value for a comparing unit 281 is greater than the non-reversed input, so that the output from the comparing unit 281 is 0, preventing the energization of the heater 234. Further, the reversed input of a comparing unit 300 is connected to the output of a water temperature sensor 240 through a resistor 299 and the non-reversed input is given a set value by resistors 297 and 298. If the water temperature is low, the comparing unit 300 shorts a transistor 303 but if the water temperature is high, it cuts off the transistor 303. The collector of the transistor 303 is connected to the power source through a resistor 302 and it is connected to the power circuit of the comparing unit 281. Thus, at temperatures below the set temperature, the power source for the comparing unit 281 is cut off, so that the heater 234 is not energized.

From the above, it is seen that the energization of the heater 234 is started when the $O_2$ sensor is in its active state and when the water temperature rises above the set temperature. The rest of the arrangement and operation is the same as in the preceding embodiment.

In addition, if control factors such as acceleration and full throttle are added to the terminals 264 and 265 of the control unit 232, the air-fuel ratio can be suited more properly to the operating condition of the engine. Further, the embodiment shown in FIG. 9 has been designed so that a triangular wave voltage is applied to the inversed input side of the comparing unit 257 and a signal voltage which varies with the operating condition of the engine is applied to the non-reversed input side thereof. However, the reversed connection may be made by altering the arrangement of the output amplifying circuit for driving the solenoid valve 227 or by altering the arrangement of the solenoid valve 227. The same may be said of the comparing unit 281.

Whiles there have been described herein what are at present considered preferred embodiments of the several features of the ivnention, it will be obvious to those skilled in the art that modifications and changes may be made without departing from the essence of the invention.

It is therefore to be understood that the exemplary embodiments thereof are illustrative and not restrictive of the invention, the scope of which is defined in the appended claims and that all modifications that come within the meaning and range of equivalency of the claims are intended to be included therein.

What is claimed is:

1. An apparatus for controlling the air-fuel mixture of an internal combustion engine comprising:

a control mechanism for actuating a solenoid valve between opened and closed positions, said control mechanism including a triangular-wave generator capable of generating a triangular wave having a fixed amplitude and a fixed period and a comparing unit means for receiving said triangular wave and comparing said triangular wave with electrical signals received from a plurality of sensor means disposed within said engine;

a pressure regulating means connected to a fuel line of said engine, said pressure regulating means prescribing a pressure difference across a fuel metering gate, said solenoid valve being disposed so as to regulate signals between said control mechanism and said pressure regulating means, thereby adjusting said pressure regulating means in response to said electrical signals originating from said plurality of sensor means;

a fuel flow rate measuring and distributing means disposed in said fuel line and having said fuel metering gate disposed therein;

a throttle valve disposed within a suction pipe, said throttle valve regulating air flow into said engine;

an air flow rate detecting valve disposed within said suction pipe, said air flow rate detecting valve being connected to said fuel metering gate;

a servo-mechanism connected to said control mechanism, said servo-mechanism providing a constant pressure difference across said air flow rate detecting valve disposed within said suction pipe, whereby the air fuel ratio supplied to said engine is maintained at a desired constant value.

2. An apparatus for controlling the air-fuel mixture of an internal combustion engine as in claim 1 wherein said plurality of sensor means includes an exhaust gas sensor and a water temperature sensor.

* * * * *